US011296438B1

(12) United States Patent
Lee et al.

(10) Patent No.: US 11,296,438 B1
(45) Date of Patent: Apr. 5, 2022

(54) ELECTRICAL CONNECTOR ASSEMBLY HAVING A TERMINAL-LESS CONNECTION SYSTEM

(71) Applicant: Lear Corporation, Southfield, MI (US)

(72) Inventors: Hyoun Lee, Rochester, MI (US); Lewis Galligan, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/065,351

(22) Filed: Oct. 7, 2020

(51) Int. Cl.

| | |
|---|---|
| ***H01R 12/83*** | (2011.01) |
| ***H01R 12/59*** | (2011.01) |
| ***H01R 13/639*** | (2006.01) |
| ***H01R 13/627*** | (2006.01) |

(52) U.S. Cl.
CPC ..... *H01R 12/592* (2013.01); *H01R 12/83* (2013.01); *H01R 13/6275* (2013.01); *H01R 13/639* (2013.01)

(58) Field of Classification Search
CPC .. H01R 12/592; H01R 12/83; H01R 13/6275; H01R 13/639; Y10S 439/93
See application file for complete search history.

(56) References Cited

U.S. PATENT DOCUMENTS

| | | | | |
|---|---|---|---|---|
| 4,138,188 | A * | 2/1979 | Shannon | H01R 9/0518 439/578 |
| 5,308,262 | A | 5/1994 | Chishima | |
| 5,378,161 | A * | 1/1995 | Loder | H01R 12/714 439/496 |
| 5,807,130 | A | 9/1998 | Miller et al. | |
| 6,755,680 | B2 | 6/2004 | Okamura et al. | |
| 7,063,560 | B2 * | 6/2006 | Asao | H01R 12/774 439/496 |
| 7,232,334 | B2 * | 6/2007 | Shimizu | H01R 12/592 439/493 |
| 9,300,085 | B2 | 3/2016 | Morello et al. | |
| 9,871,313 | B2 | 1/2018 | Saito et al. | |

* cited by examiner

*Primary Examiner* — Tho D Ta
(74) *Attorney, Agent, or Firm* — MacMillan, Sobanski & Todd, LLC

(57) ABSTRACT

An electrical connector assembly includes an electrically conductive structure having a flat flexible conductor that supports a plurality of electrically conductive traces. A wire contact wedge includes a base having an opening extending therethrough and first and second wedge arms that extend from the base. The electrically conductive structure extends through the opening of the base and between the first and second wedge arms. A connector housing supports the wire contact wedge and the electrically conductive structure. The connector housing includes a body having an abutment surface that engages a corresponding abutment surface of the base of the wire contact wedge. A front cover is supported on the connector housing and includes a retaining arm that cooperates with a corresponding protrusion provided on the wire contact wedge.

20 Claims, 10 Drawing Sheets

ELECTRICAL CONNECTOR ASSEMBLY HAVING A TERMINAL-LESS CONNECTION SYSTEM

BACKGROUND OF THE INVENTION

This invention relates in general to electrical connector assemblies that facilitate mechanical and electrical connections between two electrically conductive structures. In particular, this invention relates to an improved structure for such an electrical connector assembly that can quickly and easily be secured to an electrically conductive structure, such as a flat flexible conductor having multiple electrically conductive traces, without the need for separate electrical terminals within the electrical connector assembly.

Many electrical systems are known in the art that include one or more electrically operated devices. For example, most automobiles and other vehicles include a variety of electrically operated devices that can be selectively operated for the comfort and convenience of a driver or an occupant. Typically, each of these electrically operated devices is connected to a source of electrical energy (and/or other components of the electrical system) by one or more electrical conductors. In many instances, electrical connector assemblies are provided on the electrical conductors for facilitating the installation, service, and removal of these electrically operated devices to and from the electrical system.

A typical electrical connector assembly includes an outer housing (which is usually formed from an electrically non-conductive material) and an inner electrical terminal (which is usually formed from an electrically conductive material) that is supported within the housing. The housing usually has first and second openings extending therethrough, and the electrical terminal is supported within the housing adjacent to those first and second openings. The first opening facilitates the passage of a first electrically conductive structure through the housing into engagement with the electrical terminal supported therein. The second opening facilitates the passage of a second electrically conductive structure through the housing into engagement with the electrical terminal supported therein.

Although effective, it has been found that the manufacture of known electrical connector assemblies that include both an outer housing and an inner electrical terminal is relatively time-consuming and complicated. Thus, it would be desirable to provide an improved structure for such an electrical connector assembly that can quickly and easily be secured to an electrically conductive structure, such as a flat flexible conductor having multiple electrically conductive traces, without the need for separate electrical terminals within the electrical connector assembly.

SUMMARY OF THE INVENTION

This invention relates to an improved structure for an electrical connector assembly that can quickly and easily be secured to an electrically conductive structure without the need for separate electrical terminals within the electrical connector assembly. The electrical connector assembly includes an electrically conductive structure having a flat flexible conductor that supports a plurality of electrically conductive traces. A wire contact wedge includes a base having an opening extending therethrough and first and second wedge arms that extend from the base. The electrically conductive structure extends through the opening of the base and between the first and second wedge arms. A connector housing supports the wire contact wedge and the electrically conductive structure. The connector housing includes a body having an abutment surface that engages a corresponding abutment surface of the base of the wire contact wedge. A front cover is supported on the connector housing and includes a retaining arm that cooperates with a corresponding protrusion provided on the wire contact wedge.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
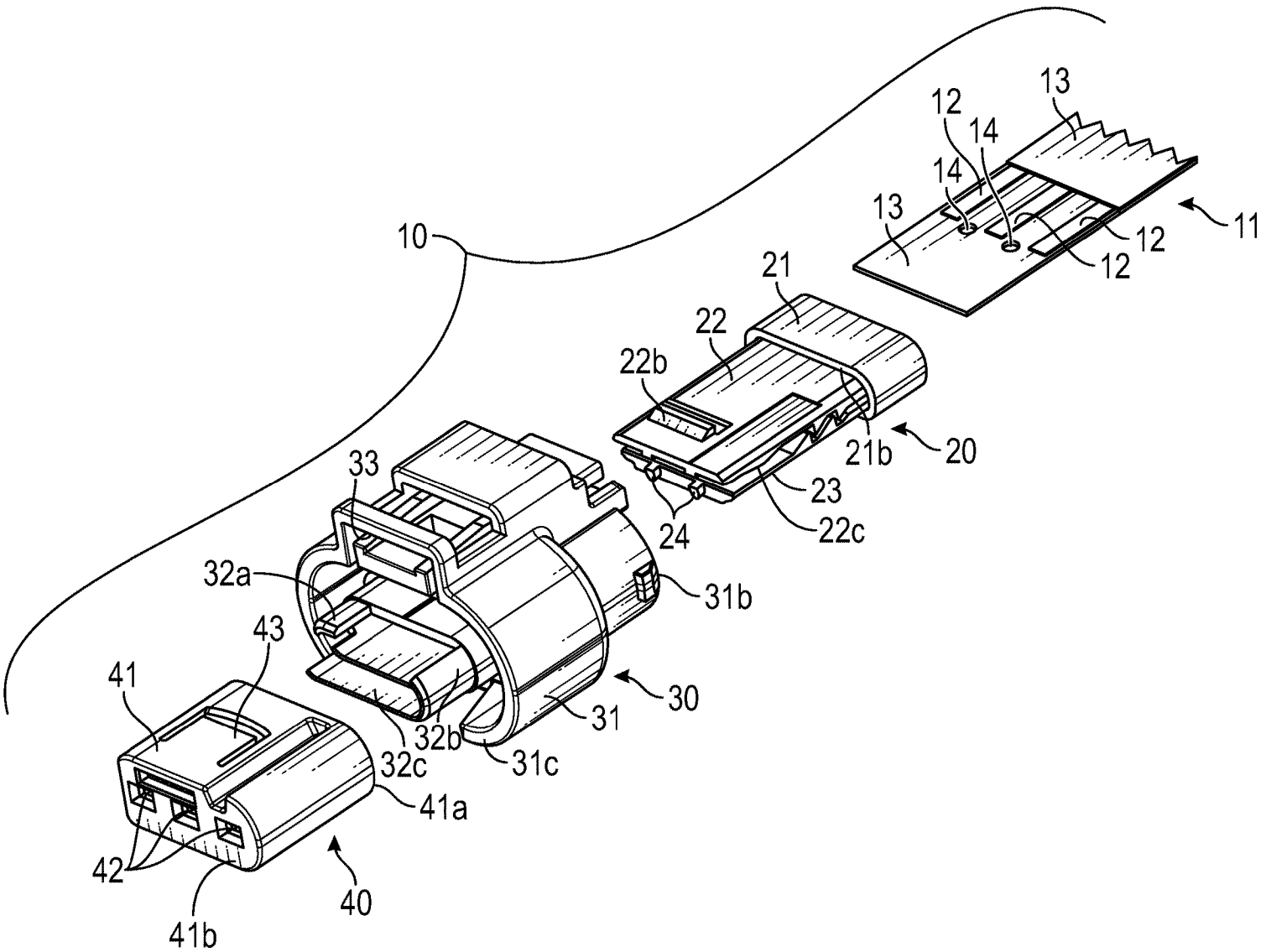
FIG. 1 is an exploded perspective view of an electrical connector assembly including a portion of an electrically conductive structure, a wire contact wedge, a connector housing, and a front cover in accordance with this invention.

Referring now to the drawings, there is illustrated in FIG. 1 an electrical connector assembly, indicated generally at 10, in accordance with this invention. The electrical connector assembly 10 includes an electrically conductive structure, indicated generally at 11. In the illustrated embodiment, the electrically conductive structure 11 is a flat flexible conductor having one or more electrically conductive traces 12 that are surrounded by an outer electrically non-conductive insulator 13. However, the electrically conductive structure 11 may have any other desired structure. As discussed above, most automobiles and other vehicles include a variety of electrically operated devices that can be selectively operated for the comfort and convenience of a driver or an occupant. Typically, each of these electrically operated devices is connected to a source of electrical energy (and/or other components of the electrical system) by one or more electrical conductors. The electrically conductive traces 12 of the electrically conductive structure 11 can be used for this purpose.

In the illustrated embodiment, the electrically conductive structure 11 includes three electrically conductive traces 12. However, the electrically conductive structure 11 may include a greater or lesser number of such electrically conductive traces 12 if desired. For a reason that will become apparent below, a portion of the electrically non-conductive insulator 13 is removed adjacent to an end of the electrically conductive structure 11 so as to expose the electrically conductive traces 12. Additionally, one or more openings 14 (two in the illustrated embodiment) extend through the illustrated electrically conductive structure 11. The purpose for the openings 14 will also be explained below. However, the openings 14 are optional and may, if desired, be omitted.

Figure 2:
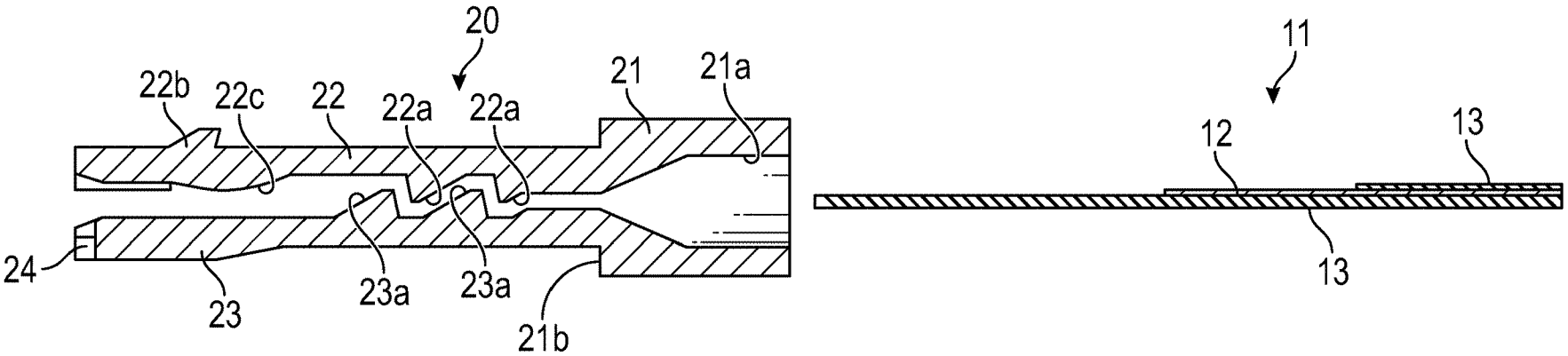
FIG. 2 is an exploded side sectional view of the electrically conductive structure and the wire contact wedge illustrated in FIG. 1.
Figure 3:
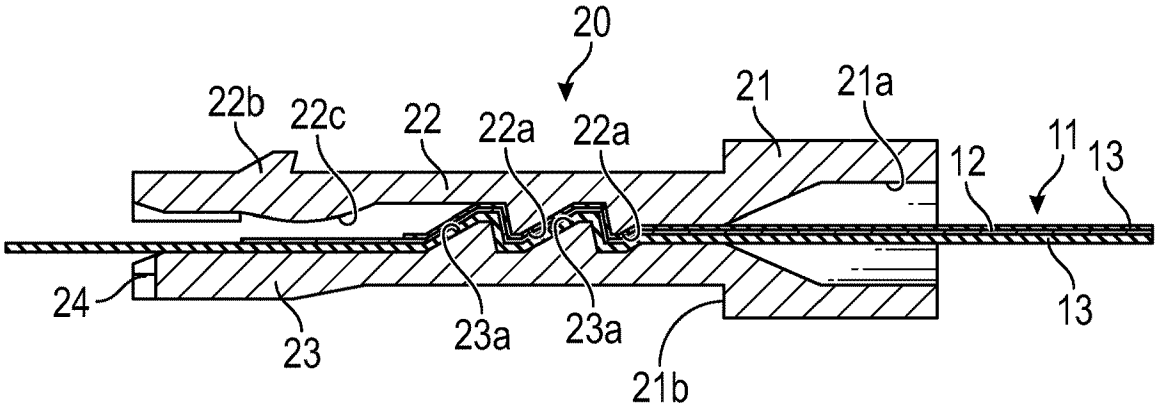
FIG. 3 is a side sectional view similar to FIG. 2 showing the electrically conductive structure after assembly with the wire contact wedge.
Figure 4:
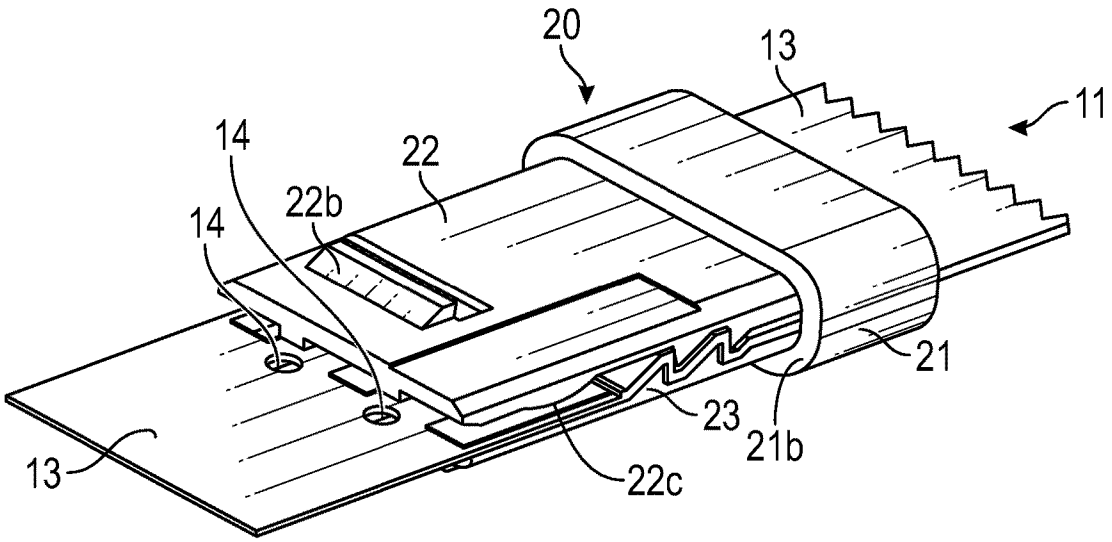
FIG. 4 is a perspective view of the assembly of the electrically conductive structure and the wire contact wedge illustrated in FIG. 3.

The electrical connector assembly 10 of this invention also includes a wire contact wedge, indicated generally at 20. As best shown in FIGS. 2, 3, and 4, the wire contact wedge 20 includes a base 21 having an opening 21*a* that extends from a first axial end of the wire contact wedge 20 to a second axial end thereof. The base 21 also has an axially-facing abutment surface 21*b* provided thereon for a purpose that will be explained below. First and second wedge arms 22 and 23 extend axially from the axially-facing abutment surface 21*b* provided at the second axial end of the base 21 on opposite sides of the opening 21*a*. The inwardly facing surface of the first wedge arm 22 has a pair of projections 22*a* (best shown in FIG. 2) provided thereon. Similarly, the inwardly facing surface of the second wedge arm 23 has a pair of projections 23*a* (also best shown in FIG. 2) provided thereon. The illustrated projections 22*a* and 23*a* face toward one another and are axially offset from one another, although such is not required. Rather, any desired number of such projections 22*a* and 23*a* may be provided at any desired locations on the first and second wedge arms 22 and 23, respectively. Alternatively, the projections 22*a* and 23*a* may be omitted if desired.

As best shown in FIG. 2, the outwardly facing surface of the first wedge arm 22 has a retaining protrusion 22*b* provided thereon. Additionally, the inwardly facing surface of the first wedge arm 22 has a plurality of axially-extending embossments 22*c* (only one of which can be seen in FIG. 2) provided thereon. Preferably, the number of such axially-extending embossments 22*c* is the same as the number of traces 12 provided on the electrically conductive structure 11, although such is not required. Also, such axially-extending embossments 22*c* are also preferably located on the first wedge arm 22 so as to be respectively aligned with the traces 12 provided on the electrically conductive structure 11 as discussed below, although again such is not required. Finally, one or more positioning protrusions 24 (two in the illustrated embodiment) extend axially from an end of the second wedge arm 24. However, the protrusions 24 are optional and may, if desired, be omitted. The purposes of the outwardly facing retaining protrusion 22*b*, the embossments 22*c*, and the positioning protrusions 24 will be explained below.

FIGS. 2, 3, 4, and 5 illustrate how the electrically conductive structure 11 can be assembled with the wire contact wedge 20. Initially, as shown in FIG. 2, a leading end of the electrically conductive structure 11 is axially aligned with the first axial end of the base 21 of the wire contact wedge 20, adjacent to the opening 21*a* therethrough. Then, as shown in FIGS. 3 and 4, the leading end of the electrically conductive structure 11 is inserted through the opening 21*a* and moved axially through the base 21 of the wire contact wedge 20. During such axial movement of the electrically conductive structure 11 through the wire contact wedge 20, the first and second wedge arms 22 and 23 preferably move apart from one another to allow the electrically conductive structure 11 to pass through the area between the projections 22*a* and 23*a*. Thus, it is desirable (but not necessarily required) that the first and second wedge arms 22 and 23 be sufficiently flexible to allow this movement to occur.

Figure 5:
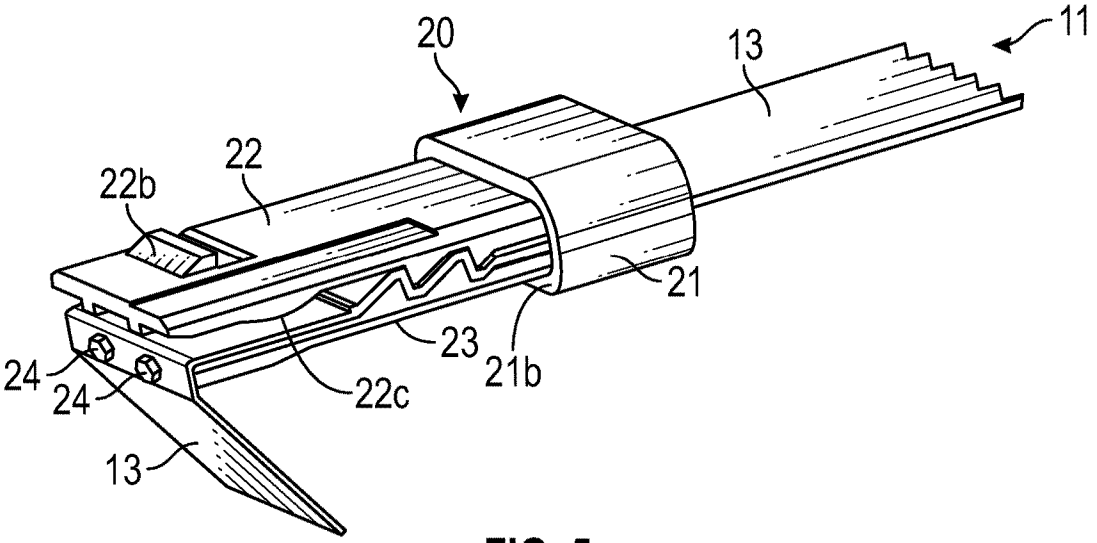
FIG. 5 is a perspective view similar to FIG. 4 showing the electrically conductive structure after being partially deformed about an end of the wire contact wedge.

Such axial movement is continued until the holes 14 extending through the electrically conductive structure 11 are disposed adjacent to the protrusions 24 provided on the axial end of the second wedge arm 24 of the wire contact wedge 20. Lastly, as shown in FIG. 5, the end of the electrically conductive structure 11 is deformed such that the holes 14 extending through the electrically conductive structure 11 are respectively disposed about the protrusions 24 provided on the axial end of the second wedge arm 24 of the wire contact wedge 20. As a result, the electrically conductive structure 11 is positively positioned relative to the wire contact wedge 20 to prevent relative axial movement from occurring therebetween.

The electrical connector assembly 10 of this invention additionally includes a connector housing, indicated generally at 30. As will be explained below, the connector housing 30 is adapted to receive and support the assembly of the wire contact wedge 20 and the electrically conductive structure 11 therein. To accomplish this, the illustrated connector housing 30 includes a body 31 having an opening 31*a* that extends axially from a first axial end 31*b* (the right end when viewing FIGS. 6, 7, and 8) to a second axial end 31*c* (the left end when viewing FIGS. 6, 7, and 8). In the illustrated embodiment, the portion of the opening 31*a* that is adjacent to the first axial end 31*b* of the body 31 is larger than the portion of the opening 31*a* that is adjacent to the second axial end 31*c* of the body 31, although such is not required. As a result, an axially-facing abutment surface 31*d* is defined within the opening 31*a* extending through the body 31.

Also, one or more supports 32*a* and 32*b* (two in the illustrated embodiment) extend axially away from the second axial end 31*c* of the body 31 of the connector housing 30, adjacent to the opening 31*a*. In the illustrated embodiment, an inwardly facing surface of the support 32*b* has a recessed area 32*c* provided thereon. Lastly, a retaining aperture 33 is provided on the body 31 adjacent to the second axial end 31*c* thereof. The purposes for the axially-facing abutment surface 31*d*, the supports 32*a* and 32*b*, the recessed area 32*c*, and the retaining aperture 33 will also be explained below.

Figure 6:
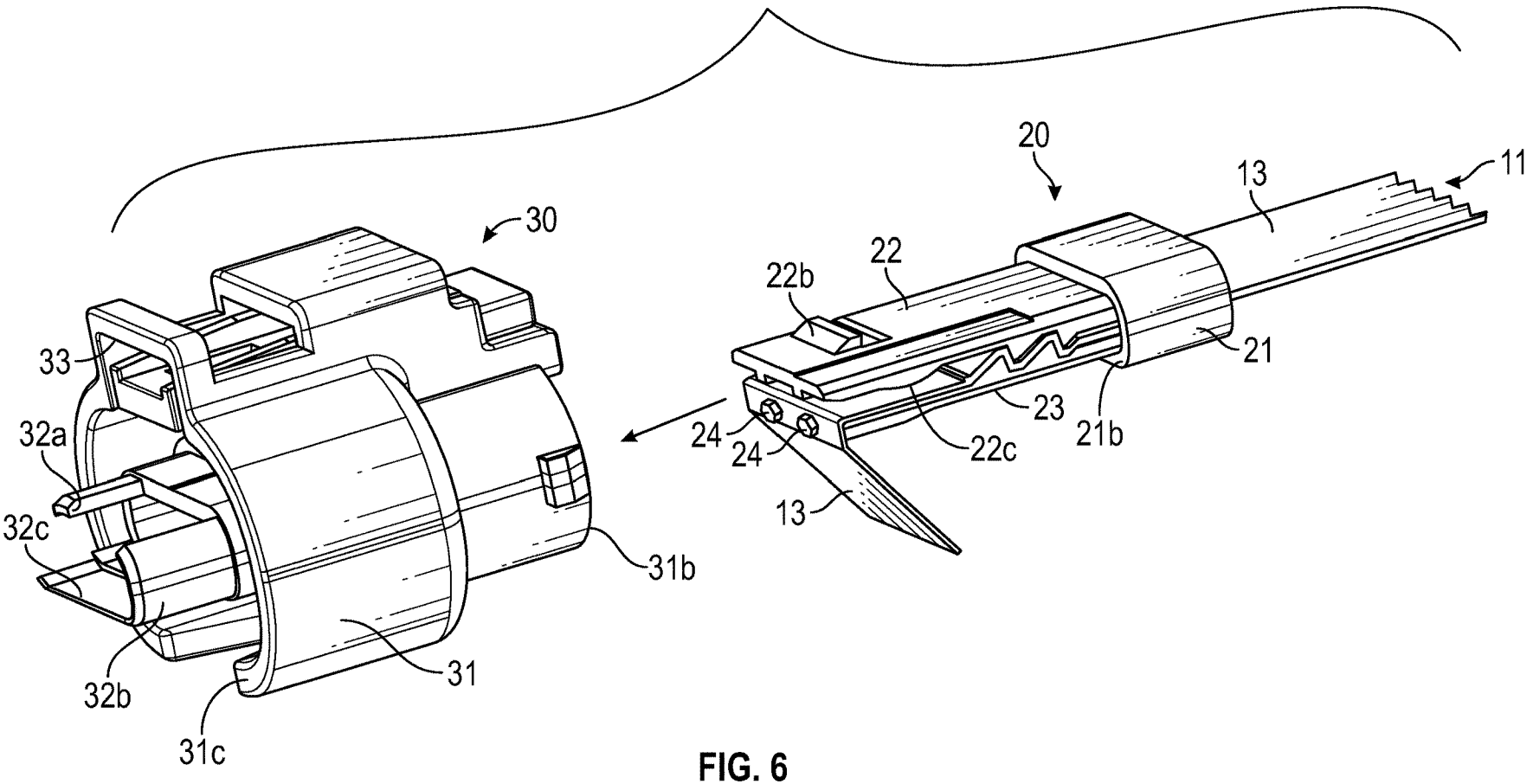
FIG. 6 is an exploded perspective view of the assembly of the electrically conductive structure and the wire contact wedge illustrated in FIG. 5 shown prior to assembly with the connector housing illustrated in FIG. 1.
Figure 7:
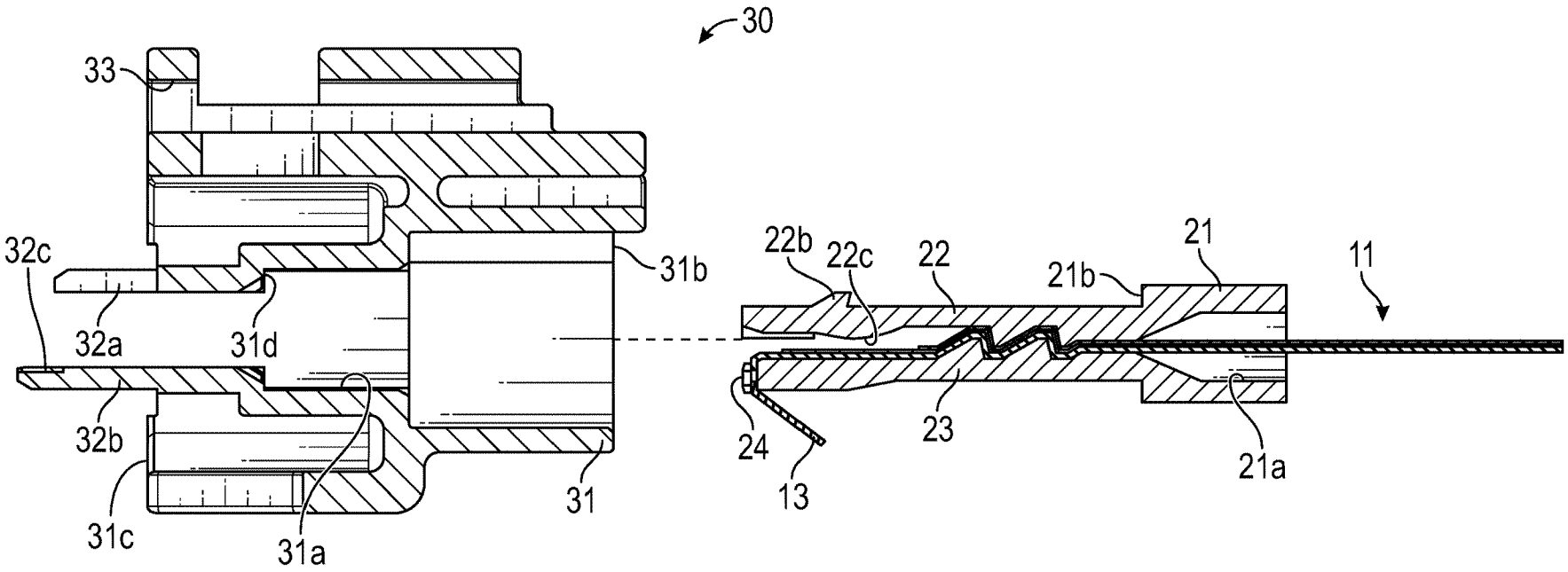
FIG. 7 is an exploded side sectional view of the assembly of the electrically conductive structure and the wire contact wedge and the connector housing illustrated in FIG. 6.
Figure 8:
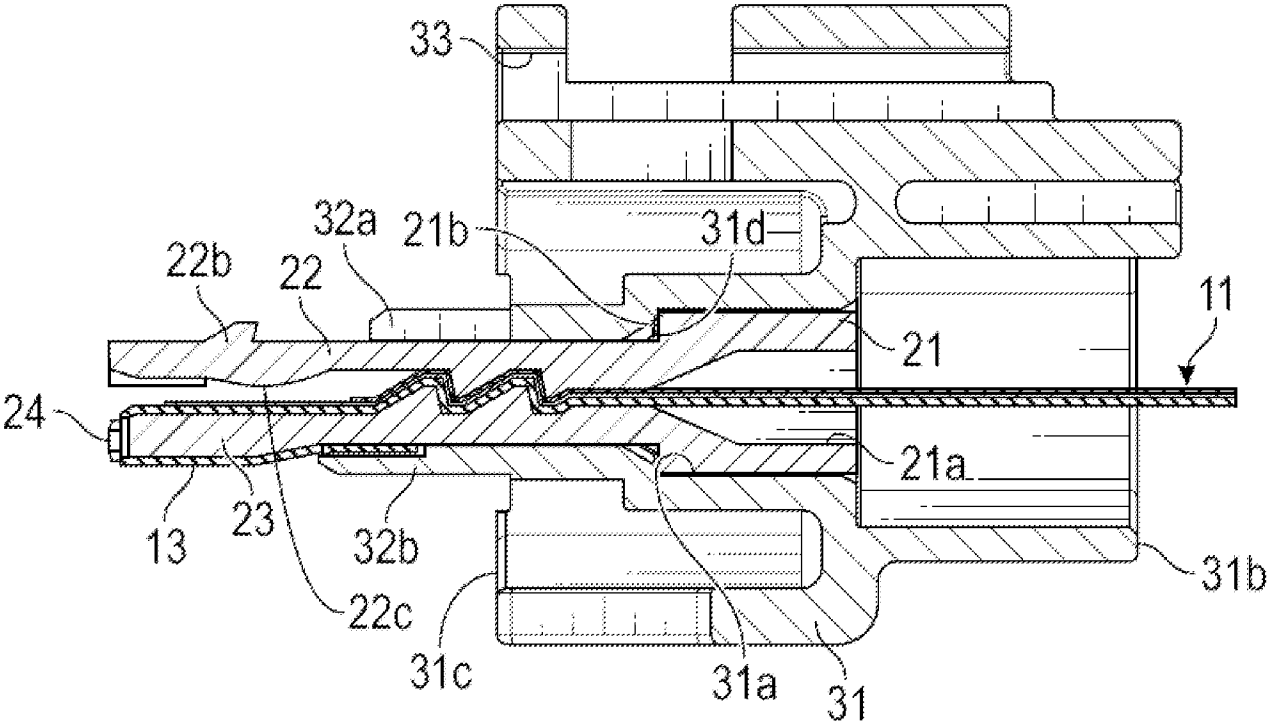
FIG. 8 is a side sectional view similar to FIG. 7 showing the assembly of the electrically conductive structure and the wire contact wedge after assembly with the connector housing.

FIGS. 6, 7, and 8 illustrate how the assembly of the wire contact wedge 20 and the electrically conductive structure 11 can be assembled with the connector housing 30. Initially, as shown in FIGS. 6 and 7, the assembly of the wire contact wedge 20 and the electrically conductive structure 11 is axially aligned with the first axial end 31*b* of the connector housing 30, adjacent to the first end of the opening 31*a* therethrough. Then, as shown in FIG. 8, the assembly of the wire contact wedge 20 and the electrically conductive structure 11 is inserted through the opening 31*a* and moved axially through the body 31 of the connector housing 30 (from right to left when viewing FIG. 8). Such axial movement is continued until the abutment surface 21*b* provided on the base 21 of the wire contact wedge 20 engages the abutment surface 31*b* provided within the body 31 of the contact housing 30, as shown in FIG. 8. As a result, further axial movement of the assembly of the contact wedge 20 and the electrically conductive structure 11 is prevented. In this orientation, the wedge arms 22 and 23 extend between and are supported by the supports 32*a* and 32*b* extending from the second end 31*c* of the body 31 of the connector housing 30 adjacent to the opening 31*a*. At the same time, a portion of the end of the electrically conductive structure 11 is received within the recessed area 32*c* provided on the inwardly facing surface of the support 32*b* of the body 31. As a result, the end of the electrically conductive structure 11 is positively positioned relative to the connector housing 30.

Lastly, the electrical connector assembly 10 of this invention includes a front cover, indicated generally at 40, that is adapted to be received within and supported on the assembly of the connector housing 30, the wire contact wedge 20, and the electrically conductive structure 11. The illustrated front cover 40 includes a hollow body 41 that extends axially from an opened axial end 41*a* axial to a closed end 41*b*. One or more openings 42 extend generally axially through the closed axial end 41*b* of the hollow body 41 to the interior thereof. In the illustrated embodiment, three of such openings 42 extend through the closed end 41*b* of the hollow body 41. Preferably, the number of such openings 42 is the same as the number of traces 12 provided on the electrically conductive structure 11, although such is not required. Also, it is preferable that each of the openings 42 is axially aligned with a respective one of the traces 12, although again such is not required. Lastly, a flexible retaining arm 43 is formed integrally with or otherwise provided on the hollow body 41 of the front cover 40. The purposes for the front cover 40, the openings 42, and the retaining arm 43 will be explained below.

Figure 9:
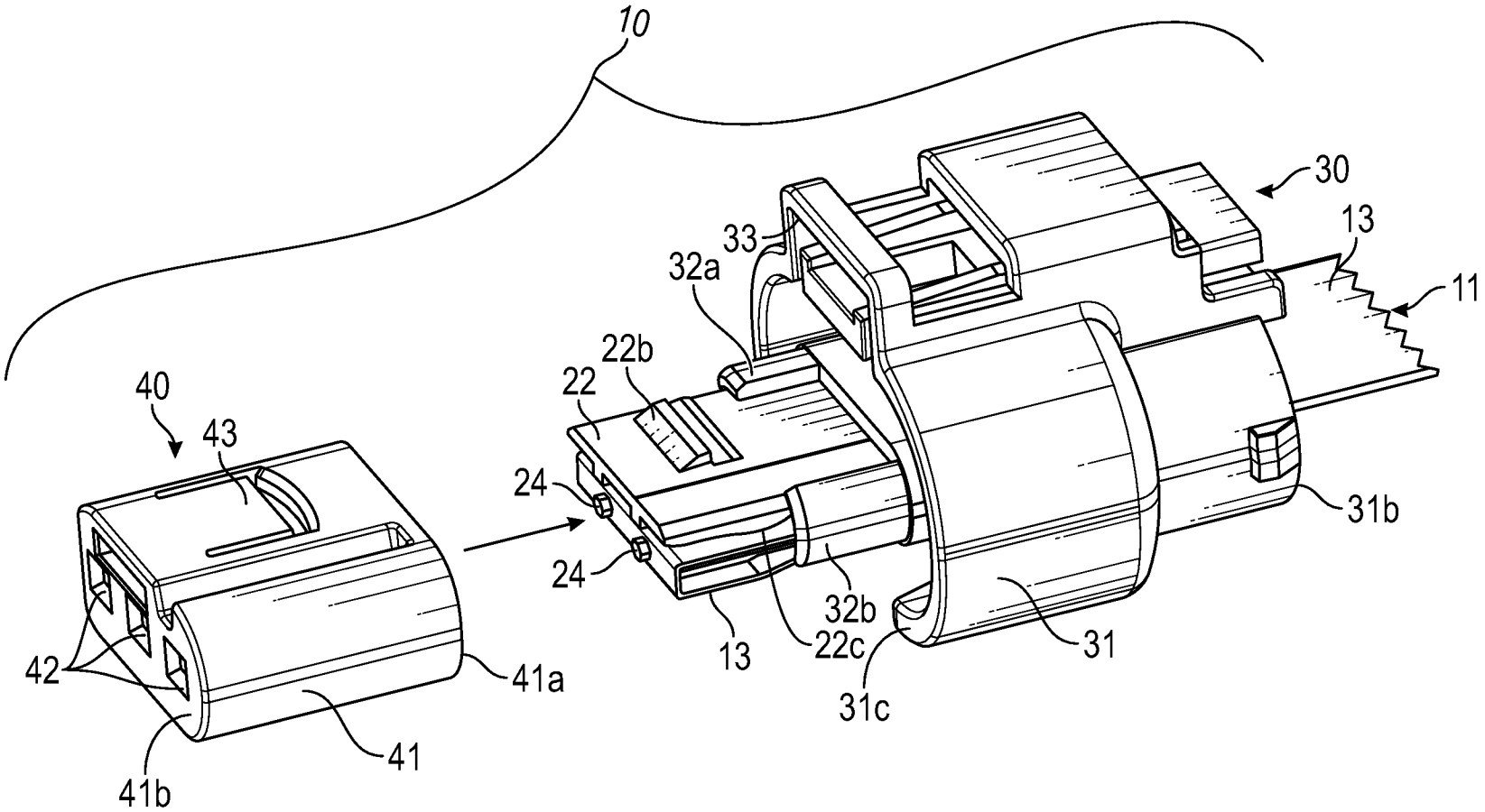
FIG. 9 is an exploded perspective view of the assembly of the electrically conductive structure, the wire contact wedge, and the connector housing illustrated in FIG. 8 shown prior to assembly with the front cover illustrated in FIG. 1.
Figure 10:
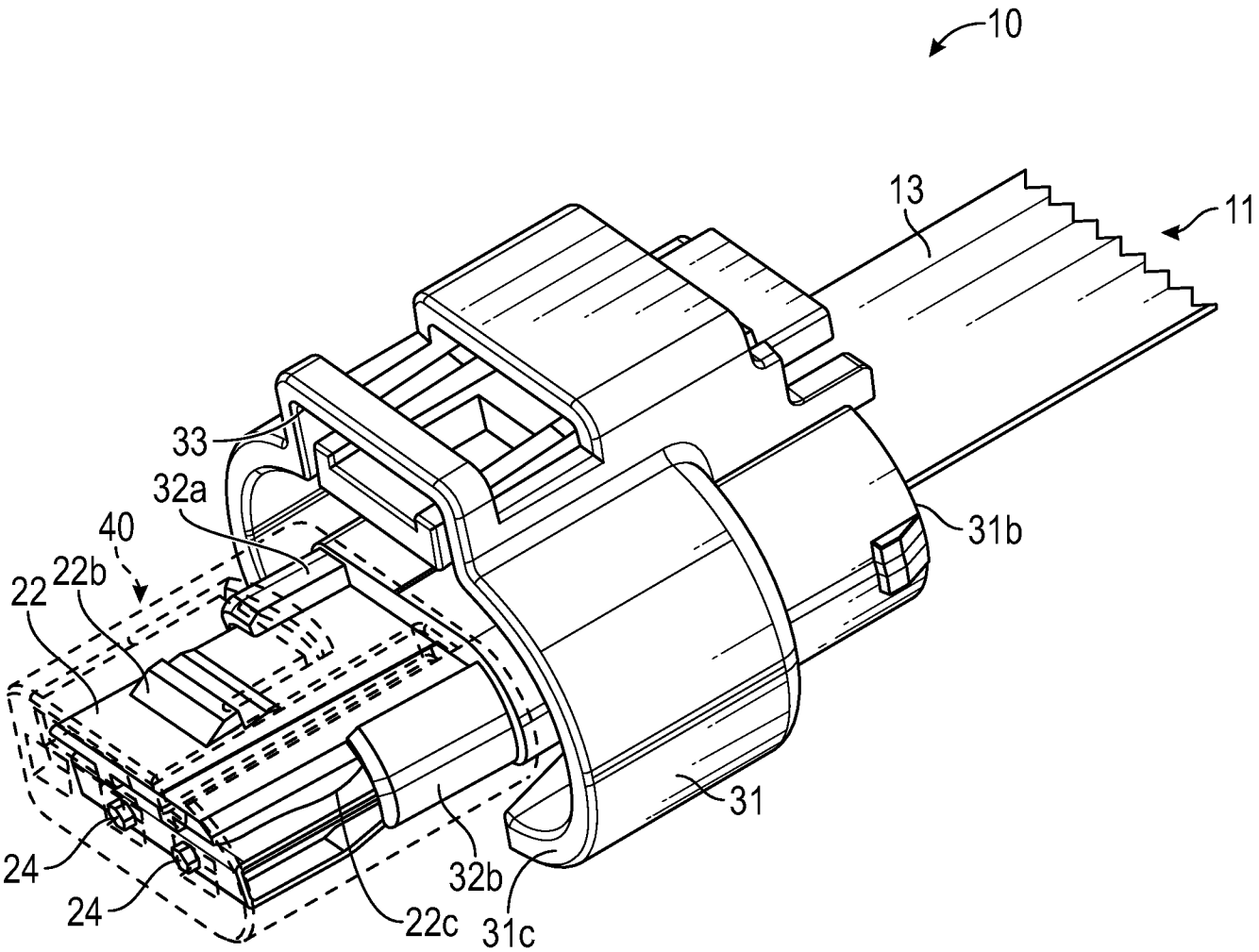
FIG. 10 is a perspective view similar to FIG. 9 showing the assembly of the electrically conductive structure, the wire contact wedge, and the connector housing after assembly with the front cover (which is shown in phantom for the sake of clarity) to form the electrical connector assembly.
Figure 11:
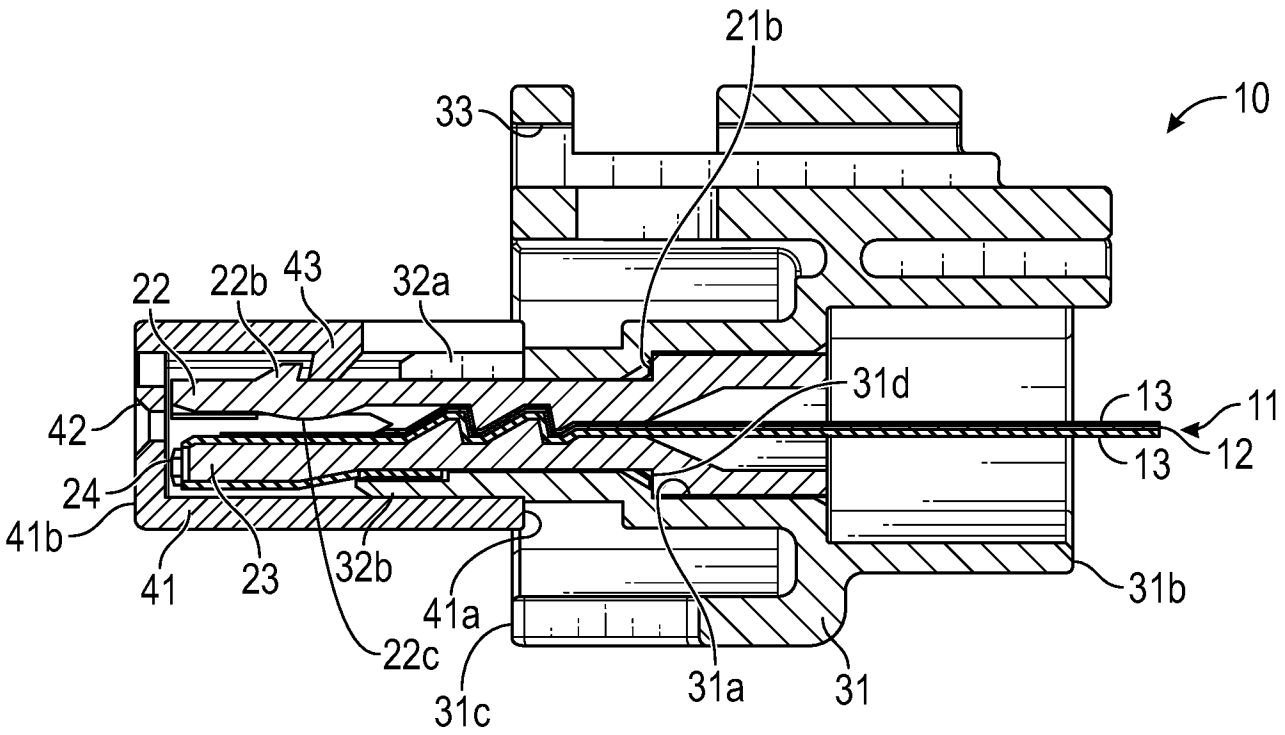
FIG. 11 is a side sectional view of the electrical connector assembly illustrated in FIG. 10.

FIGS. 9, 10, and 11 illustrate how the assembly of the connector housing 30, the wire contact wedge 20, and the electrically conductive structure 11 can be assembled with the front cover 40. Initially, as shown in FIG. 9, the assembly of the connector housing 30, the wire contact wedge 20, and the electrically conductive structure 11 is axially aligned with the body 41 of the front cover 40, adjacent to the opened axial end 41*a* thereof. Then, as shown in FIGS. 10 and 11, the body 41 of the front cover 40 is moved axially toward the second axial end 31*c* of the body 31 of the connector housing 30 such that the supports 32*a* and 32*b* of the body 31 move axially through the opened axial end 41*a* of the front cover 40 into the interior thereof. Such axial movement continues until the opened axial end 41*a* of the front cover 40 abuts the second axial end 31*c* of the connector housing 30, as best shown in FIG. 11.

When the front cover 40 is positioned in this orientation relative to the connector housing 30, an inwardly extending portion of the retaining arm 43 is disposed adjacent to the retaining protrusion 22*b* provided on the outer surface of the first wedge arm 22 of the wire contact wedge 20. The retaining arm 43 cooperates with the retaining protrusion 22*b* such that the front cover 40 is positively retained on the assembly of the connector housing 30, the wire contact wedge 20, and the electrically conductive structure 11. However, the front cover 40 may be removed from the assembly of the connector housing 30, the wire contact wedge 20, and the electrically conductive structure 11 by manually moving the retaining arm 43 outwardly out of engagement with the retaining protrusion 22*b* and pulling the front cover 40 axially in the opposite direction away from the second axial end 31*c* of the body 31 of the connector housing 30.

Figure 12:
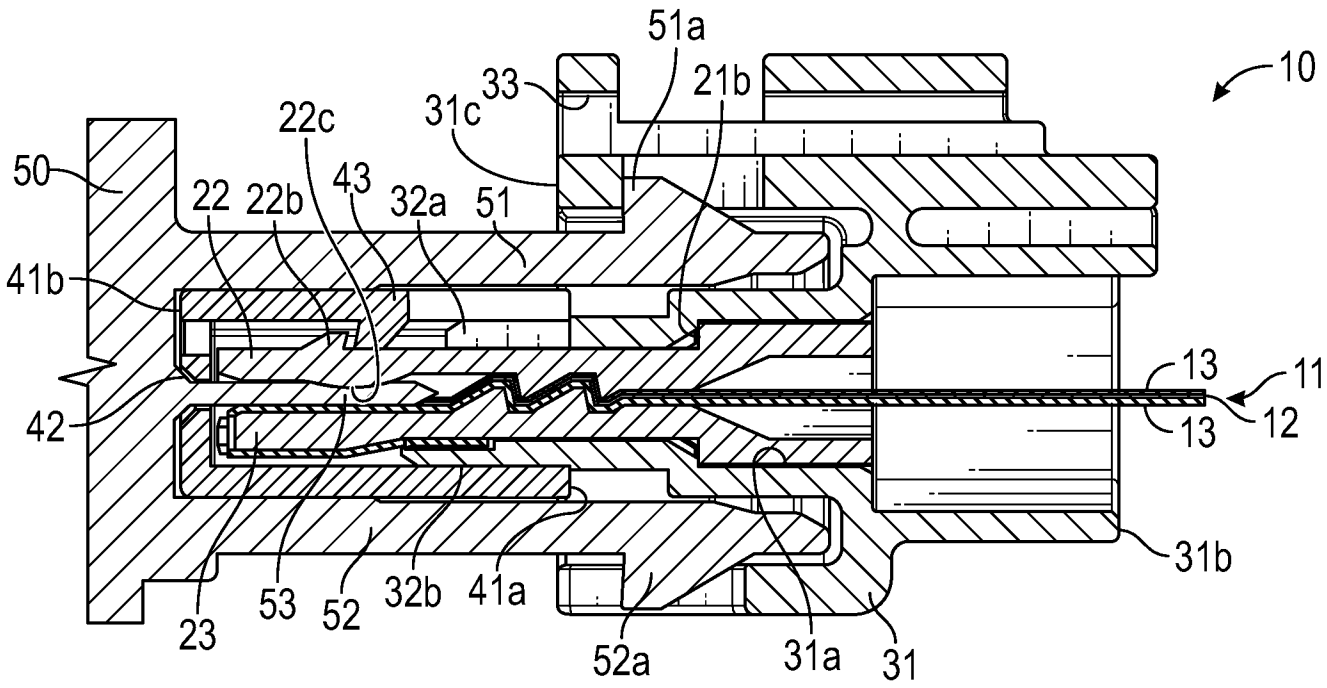
FIG. 12 is a side sectional view similar to FIG. 11 showing a second electrical connector assembly connected to the electrical connector assembly of this invention.

FIG. 12 illustrates a second electrical connector assembly 50 that can be connected to the electrical connector assembly 10 of this invention. The illustrated second electrical connector assembly 50 is conventional in the art and includes first and second axially-extending support arms 51 and 52. The first and second axially-extending support arms 51 and 52 have respective retaining portions 51*a* and 52*a* provided thereon. The second electrical connector assembly 50 also includes one or more axially-extending terminal pins 53 provided thereon. Preferably, the number of such axially-extending terminal pins 53 is the same as the number of traces 12 provided on the electrically conductive structure 11, although such is not required. Also, such axially-extending terminal pins 53 are preferably respectively aligned with the traces 12 provided on the electrically conductive structure 11, although again such is not required.

The second electrical conductor assembly 50 can be inserted within and supported on the electrical connector assembly 10 of this invention by initially aligning the second electrical connector assembly 50 with the electrical connector assembly 10 and moving it axially thereabout, as shown in FIG. 12. When so moved, the support arms 51 and 52 of the second electrical connector assembly 50 are inserted within the interior of the body 31 of the connector housing 30 such that the retaining portions 51*a* and 52*a* of the retaining arms 51 and 52 engage respective portions of the body 31 of the connector housing 30. As such, the second electrical connector assembly 50 is releasably retained on the electrical connector assembly 10 of this invention. At the same time, each of the terminal pins 53 of the second electrical connector 50 is received between a portion of the electrical connector assembly 11 and a portion of the first wedge arm 22, as also shown in FIG. 12. In particular, each of the terminal pins 53 is engaged by an associated one of the embossments 22*c* provided on the first wedge arm 22. As a result, the terminal pin 53 is affirmatively urged into engagement with the associated trace 12 provided on the electrically conductive structure 11 so as to provide a good electrical connection therebetween.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector assembly comprising:

an electrically conductive structure;

a wire contact wedge supporting the electrically conductive structure;

a connector housing supporting the wire contact wedge and the electrically conductive structure; and a front cover supported on the connector housing; wherein either:

(1) the wire contact wedge includes a base having an opening extending therethrough and first and second wedge arms that extend from the base, and the electrically conductive structure extends through the opening of the base and between the first and second wedge arms; or (2) the wire contact wedge includes a base having an abutment surface, and the connector housing includes a body having an abutment surface that engages the abutment surface of the base of the wire contact wedge.

2. The electrical connector assembly defined in claim 1 wherein the electrically conductive structure is a flat flexible conductor including a plurality of electrically conductive traces.

3. The electrical connector assembly defined in claim 1 wherein the electrically conductive structure has an opening extending therethrough, and wherein the wire contact wedge includes a protrusion that extends through the opening of the electrically conductive structure.

4. The electrical connector assembly defined in claim 1 wherein the wire contact wedge includes a base having an opening extending therethrough and first and second wedge arms that extend from the base, and wherein the electrically conductive structure extends through the opening of the base and between the first and second wedge arms.

5. The electrical connector assembly defined in claim 4 wherein each of the first and second wedge arms has a projection that engages the electrically conductive structure.

6. The electrical connector assembly defined in claim 5 wherein the projections provided on the first and second wedge arms are axially offset from one another.

7. The electrical connector assembly defined in claim 5 wherein one of the first and second wedge arms includes an embossment that is aligned with a trace provided on the electrically conductive structure.

8. The electrical connector assembly defined in claim 1 wherein the wire contact wedge includes a base having an abutment surface, and wherein the connector housing includes a body having an abutment surface that engages the abutment surface of the base of the wire contact wedge.

9. The electrical connector assembly defined in claim 8 wherein the wire contact wedge includes a protrusion, and wherein the front cover includes a retaining arm that cooperates with the protrusion provided on the wire contact wedge.

10. The electrical connector assembly defined in claim 1 wherein the wire contact wedge includes a protrusion, and wherein the front cover includes a retaining arm that cooperates with the protrusion provided on the wire contact wedge.

11. An electrical connector assembly comprising:

an electrically conductive structure including a flat flexible conductor having a plurality of electrically conductive traces;

a wire contact wedge including a base having an opening extending therethrough and first and second wedge arms that extend from the base, the electrically conductive structure extending through the opening of the base and between the first and second wedge arms;

a connector housing supporting the wire contact wedge and the electrically conductive structure; and a front cover supported on the connector housing.

12. The electrical connector assembly defined in claim 11 wherein the electrically conductive structure has an opening extending therethrough, and wherein the wire contact wedge includes a protrusion that extends through the opening of the electrically conductive structure.

13. The electrical connector assembly defined in claim 11 wherein each of the first and second wedge arms has a projection that engages the electrically conductive structure.

14. The electrical connector assembly defined in claim 13 wherein the projections provided on the first and second wedge arms are axially offset from one another.

15. The electrical connector assembly defined in claim 11 wherein one of the first and second wedge arms includes a plurality of embossments aligned with the plurality of traces provided on the electrically conductive structure.

16. The electrical connector assembly defined in claim 11 wherein the wire contact wedge includes a base having an abutment surface, and wherein the connector housing includes a body having an abutment surface that engages the abutment surface of the base of the wire contact wedge.

17. The electrical connector assembly defined in claim 16 wherein the wire contact wedge includes a protrusion, and wherein the front cover includes a retaining arm that cooperates with the protrusion provided on the wire contact wedge.

18. The electrical connector assembly defined in claim 11 wherein the wire contact wedge includes a protrusion, and wherein the front cover includes a retaining arm that cooperates with the protrusion provided on the wire contact wedge.

19. An electrical connector assembly comprising:

an electrically conductive structure;

a wire contact wedge supporting the electrically conductive structure; and a connector housing supporting the wire contact wedge and the electrically conductive structure; wherein either:

(1) the wire contact wedge includes a base having an opening extending therethrough and first and second wedge arms that extend from the base, and the electrically conductive structure extends through the opening of the base and between the first and second wedge arms; or (2) the wire contact wedge includes a base having an abutment surface, and the connector housing includes a body having an abutment surface that engages the abutment surface of the base of the wire contact wedge.

20. The electrical connector assembly defined in claim 19 wherein the electrically conductive structure includes a flat flexible conductor having a plurality of electrically conductive traces.

* * * * *